United States Patent [19]

Feldkamper et al.

[11] 4,226,149

[45] Oct. 7, 1980

[54] APPARATUS FOR TRANSVERSELY SEVERING OR TRANSVERSELY PERFORATING WEBS OF MATERIAL

[75] Inventors: Richard Feldkamper; Klaus Ginschel, both of Lengerich of Westphalia, Fed. Rep. of Germany

[73] Assignee: Windmoller & Holscher, Lengerich of Westphalia, Fed. Rep. of Germany

[21] Appl. No.: 904,311

[22] Filed: May 9, 1978

[30] Foreign Application Priority Data

May 20, 1977 [DE] Fed. Rep. of Germany ..... 2722925

[51] Int. Cl.[3] ..... B26D 1/56

[52] U.S. Cl. ..... 83/305; 83/328; 83/345

[58] Field of Search ..... 83/304, 305, 343, 345, 83/327, 337, 328

[56] References Cited

U.S. PATENT DOCUMENTS

| | | | |
|---|---|---|---|
| 2,327,106 | 8/1943 | Hallden | 83/305 |
| 2,734,570 | 2/1956 | Hallden | 83/305 |
| 3,906,827 | 9/1975 | Fritz | 83/305 |
| 3,946,629 | 3/1976 | Achelpohl | 83/345 |

FOREIGN PATENT DOCUMENTS

| | | | |
|---|---|---|---|
| 906536 | 3/1954 | Fed. Rep. of Germany . | |
| 1060235 | 6/1959 | Fed. Rep. of Germany | 83/327 |

*Primary Examiner*—W. Donald Bray
*Attorney, Agent, or Firm*—Fleit & Jacobson

[57] ABSTRACT

A machine for cutting or perforating webs of materials comprises a frame, a splined first shaft carrying a plurality of angularly spaced first tools and rotatable in the frame, a second shaft rotatable in the frame and parallel to the first shaft, supporting plates carried by the second shaft, a third shaft parallel to the first and second shafts and carrying a plurality of angularly spaced second tools for co-operating with the first tools, the third shaft being rotatable in the supporting plates eccentrically to the second shaft, a spur gear fixed to the third shaft, an intermediate gear in mesh with the spur gear loosely rotatable on one of the supporting plates, a central gear in mesh with the intermediate gear and mounted on the second shaft for rotation relatively to the supporting plates, a lever fixed to the central gear, an entrainment bolt on the lever selectively insertable in one of a plurality of holes which are provided in a swing arm at the same angular spacing as the first tools, the swing arm being rotatable on the second shaft and being selectively connectible by way of a crank rod either to a fixed pin or to a crank pin, an idler gear in the frame and carrying the crank pin, and a further gear secured to the second shaft and in mesh with the idler gear.

9 Claims, 4 Drawing Figures

APPARATUS FOR TRANSVERSELY SEVERING OR TRANSVERSELY PERFORATING WEBS OF MATERIAL

The invention relates to an apparatus for transversely severing or transversely perforating webs of material, preferably paper webs in the manufacture of paper sacks, comprising a splined shaft mounted in the frame of the apparatus and having a plurality of angularly offset tools and, co-operating with said shaft, a knife shaft which has more angularly offset tools, is rotatably mounted in end plates eccentrically to the shaft thereof, and is driven by way of a spur gear fixed to the knife shaft from an intermediate gear loosely rotatable in one of the end plates and a central gear that engages the intermediate gear, is coaxial with the end plates and freely rotatable with respect thereto.

In an apparatus of this kind known from DT-PS 906 536, the central gear is coupled to the end plate shaft by way of a switching mechanism which can be switched off and replaced so that different manners of operation are possible. With the central gear held fixed with respect to the frame, the parallel gearing consisting of the spur gear, the intermediate gear and the central gear ensures that the cutting knives on the knife shaft are carried along parallel to themselves when the end plates turn.

It is an object of the present invention to provide a cutting apparatus of the aforementioned kind which can be simply and rapidly converted in that the one tools or the tools offset therefrom at an angle can be selectively brought to the operative position, or with which excessive lengths can be cut by swinging the tools out of the cutting region.

According to the invention, this object is achieved in that the central gear is fixed to a lever having an entrainment pin and selectively insertable in a plurality of holes which are offset at the same pitch as the tools on the knife shaft and are provided in a lever that is freely rotatable on the central shaft and is selectively connectible by a crank rod on the one hand to a crank pin eccentrically mounted on a spur gear which is freely rotatable in the frame and meshes with a spur gear secured to the central shaft, the transmission ratio between the spur gear on the central shaft and the freely rotatable spur gear being selectable in dependence on the desired length to be severed and on the other hand to a pin which is fixed with respect to the frame for holding the central gear. When the cutting apparatus according to the invention is to be converted from one manner of operation to the other, the entrainment pin is released from the one hole, the central gear or the knife shaft is turned through the appropriate angle and the entrainment pin is locked in the other hole. The first tool is thereby turned out of the operative position through the given angle and the second tool faces the splined shaft. With the apparatus according to the invention it is possible to prepare the cutting apparatus for different orders within very short down times. If excessive lengths are to be cut, the crank rod is released from the fixed pin and the spur gear meshing with the gear on the central shaft is coupled. Depending on the given transmission ratio and the thrust crank motion executed by the crank rod, the knife shaft or the tool is, after a certain rotation of the cutting apparatus corresponding to the eccentricity of the crank pin, swung away from the operative position through an angle of about 40°.

If the transmission ratio of the two spur gears is, say 2:1, the tool will be swung away after every second turn of the cutting apparatus.

In the simplest form, the knife shaft is provided with two tools offset by 180°.

To enable the tools of the splined shaft also to be turned through an angle corresponding to the tools of the knife shaft, it was hitherto necessary to disengage the splined shaft from the gear connecting the central shaft by means of axial displacement, turn the splined shaft through the appropriate angle and then re-engage the gear. According to a particularly important development of the invention, the tools of the splined shaft can be turned through the required angle in a simple manner whilst maintaining their correct phase position. This resides in that the tools on the splined shaft are arranged on interconnected flanges which are displaceable on the splined shaft, are screw-connected to a flange secured to the splined shaft and are aligned therewith by radial grooves and common keys.

To connect the entrainment pin to the holes of the pivoted lever in a simple manner, it is provided that the holes contain axially easily displaceable sleeves which can be locked by screws.

It is also provided that the flange arranged adjacent the flanges carrying the grooved tools is provided with an abutment against which the head of a screw abuts on releasing the connection between these flanges. This achieves easy displacement of the grooved tools on the splined shaft.

Other advantageous embodiments of the invention are described in more detail in the subsidiary claims.

An example of the invention is hereinafter described in more detail and shown in the drawing, wherein.

Figure 1:
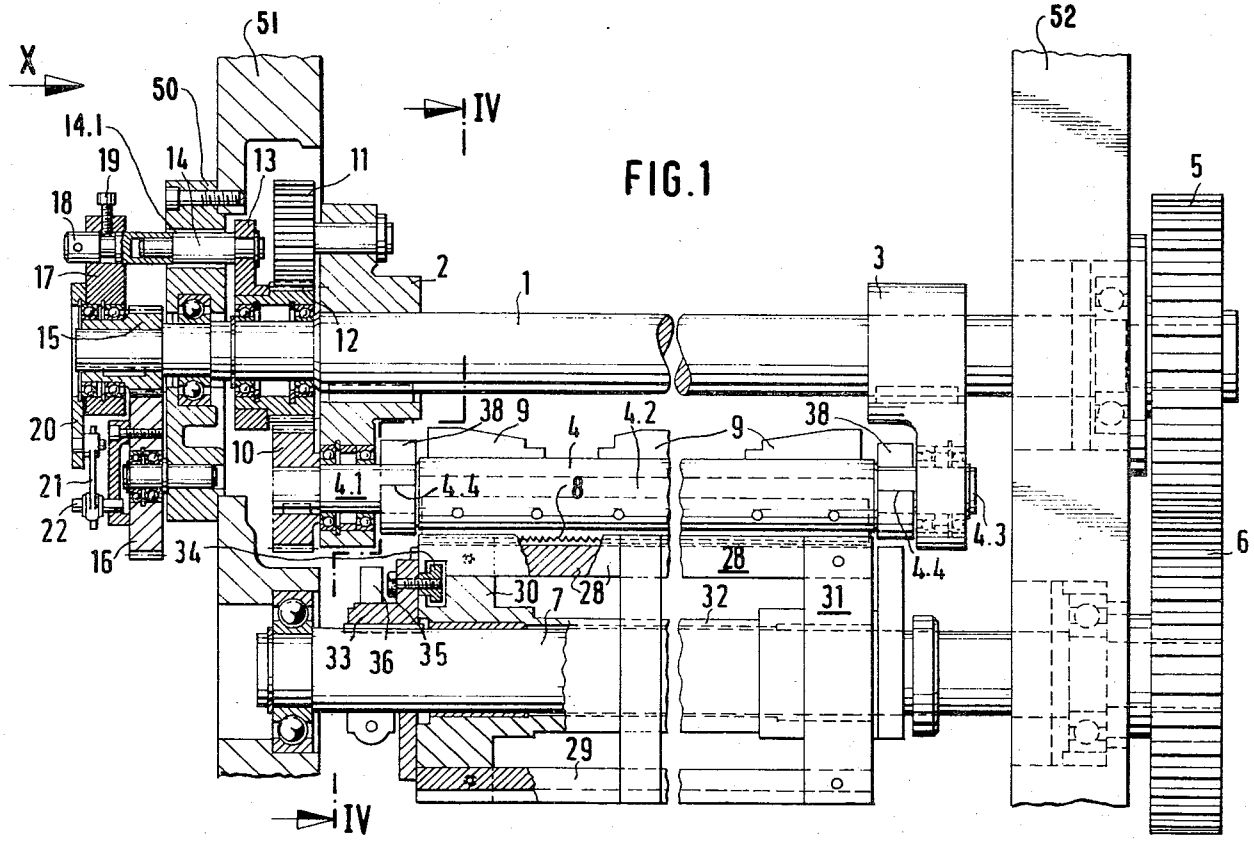
FIG. 1 is a cross-section through the cutting apparatus taken along line A-B-C-D-E of FIG. 2.
Figure 2:
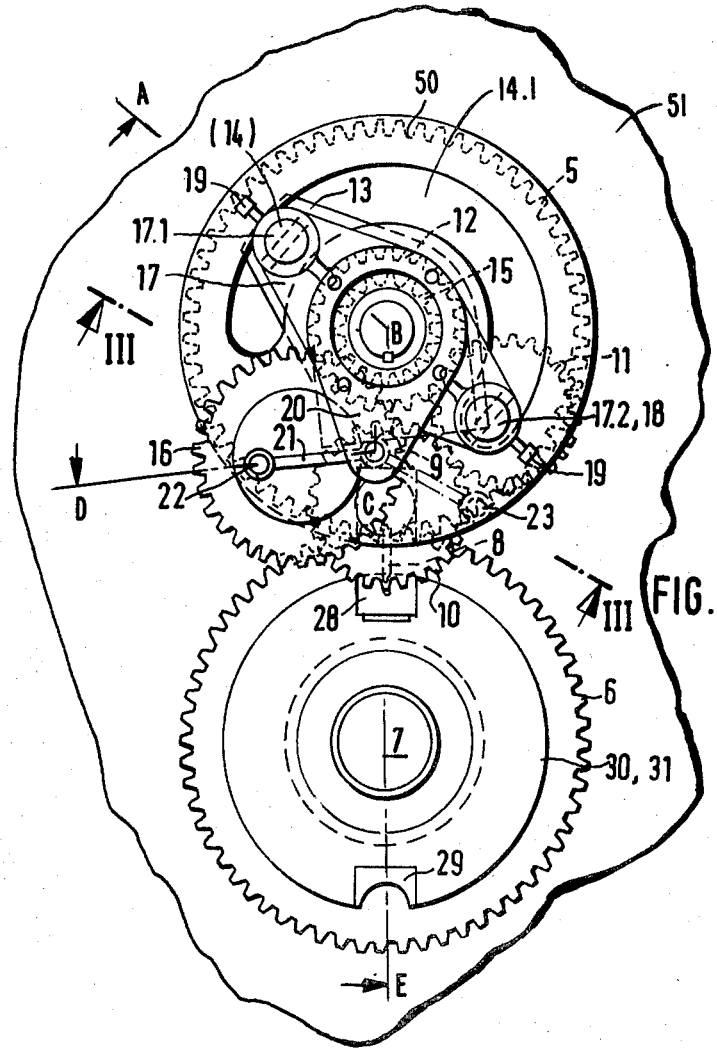
FIG. 2 is an end elevation in the direction of the arrow X.
Figure 3:
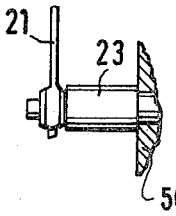
FIG. 3 is a partial section on the line III—III in FIG. 2.
Figure 4:
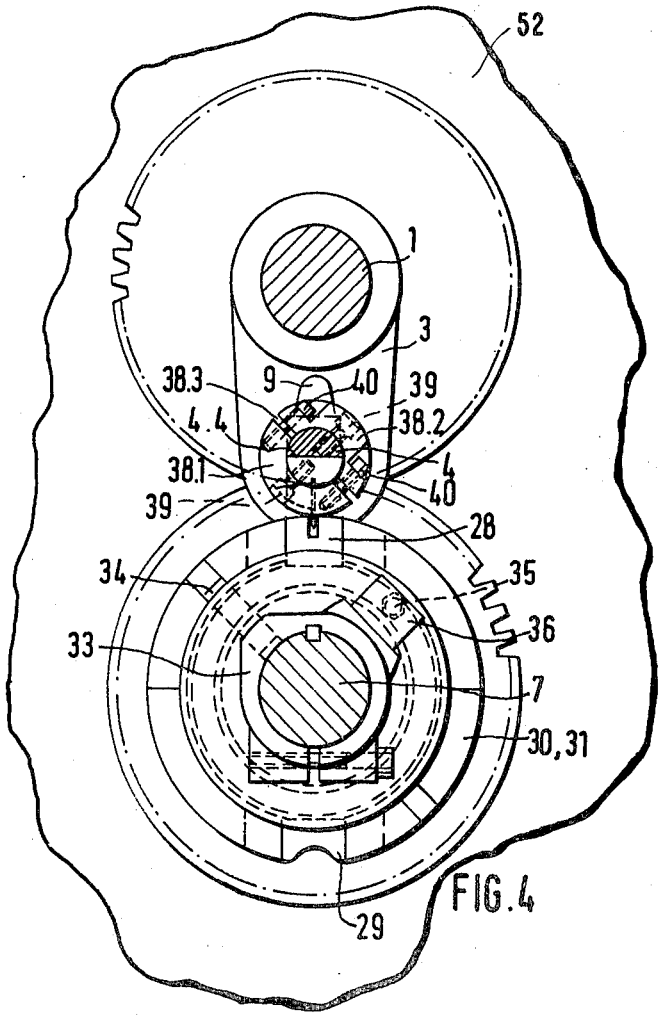
FIG. 4 is a section on the line IV—IV in FIG. 1.

End plates 2, 3 are secured on a central shaft 1 mounted in the frame members 51 and 52 of the machine and a knife shaft 4 is loosely rotatably mounted in them. Secured to the central shaft 1 there is a spur gear 5 which meshes with a spur gear 6 connected to a splined shaft 7 mounted in the frame of the machine. One of the two spur gears 5 or 6 is driven in known manner by the main drive of the machine. Secured to the knife shaft 4 there is a knife beam which carries, as illustrated in FIG. 2, tools 8, 9 displaced at 180° and of which the tool 8 is in the form of a cutting or perforating knife and the tool 9 in the form of a tear-off tool. A spur gear 10 secured to the knife shaft 4 is in mesh with an intermediate gear 11 freely rotatably mounted on the end plate 2. The gear 11 is in mesh with a central gear 12 which is loosely rotatably mounted on the central shaft 1. Also, gear 12 has the same pitch circle diameter as the spur gear 10 and has the fixed end of a one-armed lever 13 secured thereto, the other end of the lever being fixed to an entrainment pin 14. The entrainment pin passes with play through the bearing cover in which the central shaft is mounted in an elongate hole 14.1 formed in flange 50 concentric to the central shaft.

A spur gear 15 secured to the central shaft 1 is in mesh with a spur gear 16 which is freely rotatably mounted in the frame of the machine. The pitch circle of the spur gear 16 is twice that of the spur gear 15.

Finally, the central shaft 1 loosely rotatably carries a two-armed lever 17 of which the free ends have holes 17.1 and 17.2 in which sleeves 18 are easily displaceably inserted and secured against displacement in the axial direction by screws 19. The entrainment pin 14 can be fixed to one of the sleeves 18 so that the movements of the lever 17 are transmitted to the lever 13 and the central gear 12. For releasing from the one sleeve 18, i.e. the sleeve inserted in hole 17.2 and fixing to the other sleeve 18 displaced therefrom through 180°, the knife shaft 4 is turned through 180° so that one can now work with the tear-off tool 9 if the cutting knife 8 was being used previously.

A swivel lever 20 having a crank rod 21 pivoted to its free end is fixed to the two-armed lever 17. The crank rod 21 can be selectively placed on the one hand on a crank pin 22 fixed to the spur gear 16 or on a pin 23 fixed with respect to the frame. If the crank rod 21 is placed on the pin 23, the central gear 12 is held stationary so that the tool in the operative position, for example the cutting knife 8, cuts on each revolution of the central shaft 1. If the crank rod 21 is coupled to the spur gear 16, the swivel lever 20 executes one to and fro movement which causes periodical swinging of the knife shaft 4 through a maximum of about 40° so that the tool 8 or 9 is in use only during every second revolution.

Co-operating tools for the tools 8, 9 are mounted on the splined shaft 7. They consist of a cutting groove bar 28 and a tear-off tool 29. These are held by flanges 30, 31 which are interconnected by a sleeve 32. The flanges 30, 31 and the sleeve 32 are fitted on the splined shaft 7 with a slide fit. Fixed to the splined shaft 7 there is a flange 33 in the end face of which facing the flange 30 there is machined a radial groove in which a key 34 is secured. The flange 30 has a radial groove corresponding to the key 34. It is pulled towards the end face of the flange 33 by a screw 35, an abutment 36 being secured to the flange 33. The axial spacing of the abutment 36 from the end face of the flange 33 confronting same is only slightly larger than the height of the head of the screw 35 so that, on releasing the connection between the flanges 30 and 33, the head of the screw comes to lie against the abutment 36 and the flanges 30, 31 as well as the sleeve 32 are displaced to the right on the splined shaft 7 so that the radial groove of the flange 30 is released from the key 34. The tools 28, 29 or the flanges 30, 31 can now be turned through 180° and, by tightening the screw 35, the connection between the flanges 30 and 33 can be re-established by way of the key 34. The splined shaft can thereby be converted to working with other tools by means of very little manipulation.

It will be appreciated that fixing the entrainment pin 14 in one of the holes (17.1, 17.2) places either perforating knife 8 or tear off-tool 9 in a working position. Similarly, locking flanges 30 and 33 together positions one of the tools 28, 29 in a working position. Subsequent driving of either spur gear 5 or spur gear 6 rotates knife shaft 6 and splined shaft 7 so that tools 8 and 28 or tools 9 and 29 cooperate with each other to perforate or sever webs of material.

The knife shaft 4 is composed of three components: the shafts 4.1 and 4.3 as well as the knife beam 4.2. The shafts 4.1 and 4.3 are freely rotatable in the end plates 2, 3. The shaft 4.1 carries the spur gear 10. At the sides facing the knife beam, the shafts 4.1 and 4.3 have axially parallel milled faces 4.4 fitting with like faces of the knife beam 4.2. The shafts 4.1 and 4.3 are connected by cut open rings 38 to the knife beam 4.2 in the regions of the axially parallel faces 4.4. One half 38.1 of the ring 38 is securely connected to the shaft 4.1 or 4.2 by means of screws 39. The partial slits 38.3 are at an angle of about 45° to the axially parallel faces 4.4. The other halves 38.2 are screw-connected to the knife beams 4.2.

The ring segments are securely screw-connected to each other by means of screws 40 at right-angles to the partial slits 38.3. By means of this arrangement one obtains a strong and aligned connection of the knife beam 4.2 to the shafts 4.1 and 4.3 which, for the purpose of replacement of the tools 8 and 9, can be rapidly loosened and tightened.

We claim:

1. Apparatus for selectively transversely severing predetermined lengths of web material and for transversely perforating the web materials, the web materials being preferably paper webs used in the manufacture of paper sacks, comprising:

a frame;

a central shaft rotatably mounted in said frame;

end plates carried by and rotable about said central shaft;

a splined shaft mounted in said frame parallel to said central shaft;

a first plurality of angularly offset tools carried by said splined shaft;

a knife shaft rotably mounted in said end plates parallel to said central shaft;

a second plurality of angularly offset tools carried by said knife shaft, said first and second plurality of tools being selectively positionable to sever and perforate webs;

a spur gear concentric with and carried by said knife shaft for rotating said knife shaft;

an intermediate gear loosely rotatably mounted in one of said end plates for driving said spur gear;

a central gear engaged by said intermediate gear and carried by one of said end plates, said central gear being concentric with and rotatable about said central shaft;

a first lever having a first end connected to said central gear;

an entrainment pin carried by a second end of said lever;

a second lever freely rotable about said central shaft and having a plurality of arms with openings formed therein, the angular orientation of said arms coinciding with the angular orientation of tools carried by said knife shaft, said entrainment pin being selectively insertable into one of said openings;

a second spur gear freely rotable in said frame;

a crank pin eccentrically mounted on said second spur gear;

a third spur gear secured to said central shaft and meshing with said spur gear, the transmission ratio between said third spur gear and said second spur gear being selectable in dependence on the predetermined length to be severed;

a pin fixed with respect to said frame for holding said central gear stationary; and a crank rod for selectively connecting said second lever to said crank pin and said pin.

2. Apparatus according to claim 1, characterised in that the transmission ratio of said second and third spur gears is 2:1.

3. Apparatus according to claim 1, characterised in that said openings in said second lever contain axially easily displaceable sleeves which can be locked by screws.

4. Apparatus according to claim 1, characterised in that the plurality of tools on the splined shaft are arranged on interconnected flanges which are displaceable on the splined shaft, one of the flanges being screw-connected to another flange secured to the splined shaft, the one and the another flange being aligned with the splined shaft by radial grooves and common keys.

5. Apparatus according to claim 2, characterised in that the another flange is provided with an abutment against which the head of a screw abuts on releasing the connection between the one and the another flanges.

6. Apparatus according to one of claims 2 and 1, characterised in that the knife shaft comprises shaft freely rotatable in the end plates and a knife beam intermediate the shafts and carrying the plurality of tools.

7. Apparatus according to claim 6, characterised in that axially parallel faces fitting with axially parallel faces of the knife beam are milled on those sides of the shafts which face the knife beam.

8. Apparatus according to claim 7, characterised in that the shafts are connected to the knife beam by cut open rings in the regions of the axially parallel faces.

9. Apparatus according to claim 8, characterised in that the cut open rings have partial slits at an angle of about 45° to the axially parallel faces.

* * * * *